US007656138B2

(12) United States Patent
Dohnal

(10) Patent No.: US 7,656,138 B2
(45) Date of Patent: Feb. 2, 2010

(54) DEVICE FOR REGULATING ELECTRICAL VOLTAGE

(75) Inventor: Dieter Dohnal, Lappersdorf (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 341 days.

(21) Appl. No.: 11/664,364

(22) PCT Filed: Jul. 22, 2005

(86) PCT No.: PCT/EP2005/007999

§ 371 (c)(1),
(2), (4) Date: Mar. 28, 2007

(87) PCT Pub. No.: WO2006/034744

PCT Pub. Date: Apr. 6, 2006

(65) Prior Publication Data

US 2009/0140705 A1 Jun. 4, 2009

(30) Foreign Application Priority Data

Sep. 28, 2004 (DE) ..... 10 2004 046 926

(51) Int. Cl.
*G05F 1/16* (2006.01)

(52) U.S. Cl. ..... 323/258

(58) Field of Classification Search ..... 323/255, 323/258, 340, 343, 355, 359
See application file for complete search history.

(56) References Cited

U.S. PATENT DOCUMENTS

| | | | | |
|---|---|---|---|---|
| 3,195,038 | A | 7/1965 | Fry | 323/25 |
| 3,621,374 | A * | 11/1971 | Kettler | 323/343 |
| 3,732,486 | A * | 5/1973 | Schoendube | 323/263 |
| 6,137,277 | A * | 10/2000 | Rajda et al. | 323/301 |
| 6,384,588 | B1 | 5/2002 | Mulhauser | |
| 6,472,851 | B2 * | 10/2002 | Hammond | 323/258 |
| 6,740,826 | B1 | 5/2004 | Friedrich et al. | |
| 6,762,594 | B1 | 7/2004 | Hauer | |
| 6,924,631 | B2 | 8/2005 | Hauer | |
| 7,250,743 | B2 * | 7/2007 | McVicar | 323/255 |
| 2005/0017696 | A1 | 1/2005 | Hauer | |

* cited by examiner

*Primary Examiner*—Gary L Laxton
(74) *Attorney, Agent, or Firm*—Andrew Wilford

(57) ABSTRACT

An apparatus for regulating electrical voltage in multiphase power mains has a control transformer having for each phase of the power mains a primary winding and a control winding having three taps. The second tap is connected centrally between the first and third taps and to one of the ends of the primary winding. This control winding has winding lengths between the first and second taps and second and third taps equal to a whole-number multiple of a winding length of the primary winding. Three circuit elements have inputs connected to the taps. A reactor winding has ends connected to outputs of the first and second circuit elements, while the output of the third circuit element electrically connected to the output of the first circuit element. A further circuit element is connected across the reactor winding, and an output is connected to a center of the reactor winding.

5 Claims, 7 Drawing Sheets

| Step | 1 | 2 | 3 | 4 | 5 |
|---|---|---|---|---|---|
| % Reg | -5 % | -2.5 % | 0 % | +2.5 % | +5 % |
| OS | | | | | |
| V1 | c | c | o | o | o |
| V2 | o | c | c | c | o |
| V3 | o | o | o | c | c |
| V4 | c | o | c | o | c |

Fig.2

DEVICE FOR REGULATING ELECTRICAL VOLTAGE

CROSS REFERENCE TO RELATED APPLICATIONS

This application is the US national phase of PCT application EP2005/007999, filed 22 Jul. 2005, published 6 Apr. 2006 as WO2006/034744, and claiming the priority of German patent application 102004046926.1 itself filed 28 Sep. 2004, whose entire disclosures are herewith incorporated by reference.

FIELD OF THE INVENTION

The invention relates to a voltage regulator for power-supply lines.

BACKGROUND OF THE INVENTION

In today's extensive centralized energy supply system, voltage control generally is effected by means of control transformers in the central nodes of the high or medium high voltage systems. For this purpose, the windings of the control transformers are provided with taps and it is possible to switch between adjacent winding taps without interruption under load by means of tap changers.

Generally, there exist two types of suitable tap changers: high-speed circuit breakers in which transition resistors are present and which can only be loaded during short periods of time for limiting the circuit current flowing during the switching operation and accordingly, effect a rapid switching between the winding taps, as well as those of the reactor switch type in which inductive transition impedances are used giving as a result a slow and continuous switching.

In the above-described voltage control in the field of high and medium-high voltage systems, it is however not possible to easily provide local control in distribution transformers in decentralized power-supply systems.

For this control that is effected close to the consumer in decentralized power supply systems, in particular in the USA, so-called "Voltage Regulators" have become widely accepted. Most common "Voltage Regulators" are single-phase, possess inductive transition impedances that are also referred to as reactor or reactor windings and enable 32-step voltage control, each step at ⅝%, i.e. in the range of +/−10%.

A different type of "Voltage regulator" is that of the Auto Boosters® type. This device has a less complicated structure and enables forward control in four steps of respectively 2½ or 1½%, i.e. +10 or +6% in total.

A further approach for providing voltage control that is close to the consumer in the field of low voltages is described in WO 2001/033308 [US equivalents U.S. Pat. Nos. 6,762,594 and 6,924,63] and WO 2003/044611 [US equivalent 20050017696]. Both applications in general are based on the object of providing a control transformer having a small number taps. Here, the individual partial windings are optionally looped by means of a changeover switch, the control transformer having a leakage impedance that is sufficient for limiting the circuit current to the order of the nominal current in the case of a short circuit of adjacent taps of the partial windings, which can occur during short periods of time when switching under load. The typical transition resistances of traditional tap changers can thus be avoided. In this arrangement, which is suitable for use as a control transformer of the autotransformer type or of a split-winding transformer type, different designs of the changeover switch are possible. Thus, it is proposed to use as changeover switch a load changeover switch of a tap changer that has no resistance contacts but only main contacts. According to other proposals, the changeover switch is designed as multiple cam stepping switch, optionally also composed of a series of relays or contactors, or finally, also consisting of a series of electronic switches, in particular thyristors. The number of possible positions thus corresponds to the number of required circuit elements of the changeover switch.

The disadvantage of this state of the art is that in particular in the case of the split-winding transformer, a separate primary and control winding must be provided. For raising the leakage inductance of each level such that the short-circuit current of the respective level only reaches the order of the nominal voltage, a short leakage channel is required. As a result a separate, short control winding is used and consequently leads to increased width and depth of the transformer. This additional expense of transformer costs is higher in many cases than gain obtained due to thus avoided transition resistances. Furthermore, the control performance is difficult; the known arrangement in particular is not suitable for parallel connections.

OBJECT OF THE INVENTION

An object of the invention is to provide an easy and cost-efficient apparatus for regulating the electrical voltage for distribution transformers and voltage regulators that have the lowest possible number of switches.

SUMMARY OF THE INVENTION

This object is attained by an apparatus according to the invention preferably used for the regulation of distribution transformers and having a small range of regulation of for example +/−5% in steps of 2.5%, that is, in total for example five steps. The apparatus according to the invention is suitable for oil-filled transformers as well as for air-cooled transformers. The particular advantage is that only a minimum increase of the dimensions of the respective distribution transformer is required and a high usability and operational reliability are ensured. This is due to the fact that the apparatus according to the invention is designed as a switching apparatus that does not require the mechanically moved selectors or load selectors of a tap changer. The apparatus according to the invention furthermore is of low complexity; in particular it has only a few components as well as switches. For example only four switches are required for a design having five regulating voltage levels that can be selected that will be explained in further detail below. These switches can be designed particularly advantageous as an antiparallel thyristor pair or also as a vacuum switching cell.

BRIEF DESCRIPTION OF THE DRAWING

The invention in the following is to be explained in further detail by means of drawings. In the drawings:

FIG. 2 shows a table of the voltage levels that can be achieved in this apparatus in accordance with the position of the individual circuit elements;

SPECIFIC DESCRIPTION

Figure 1:
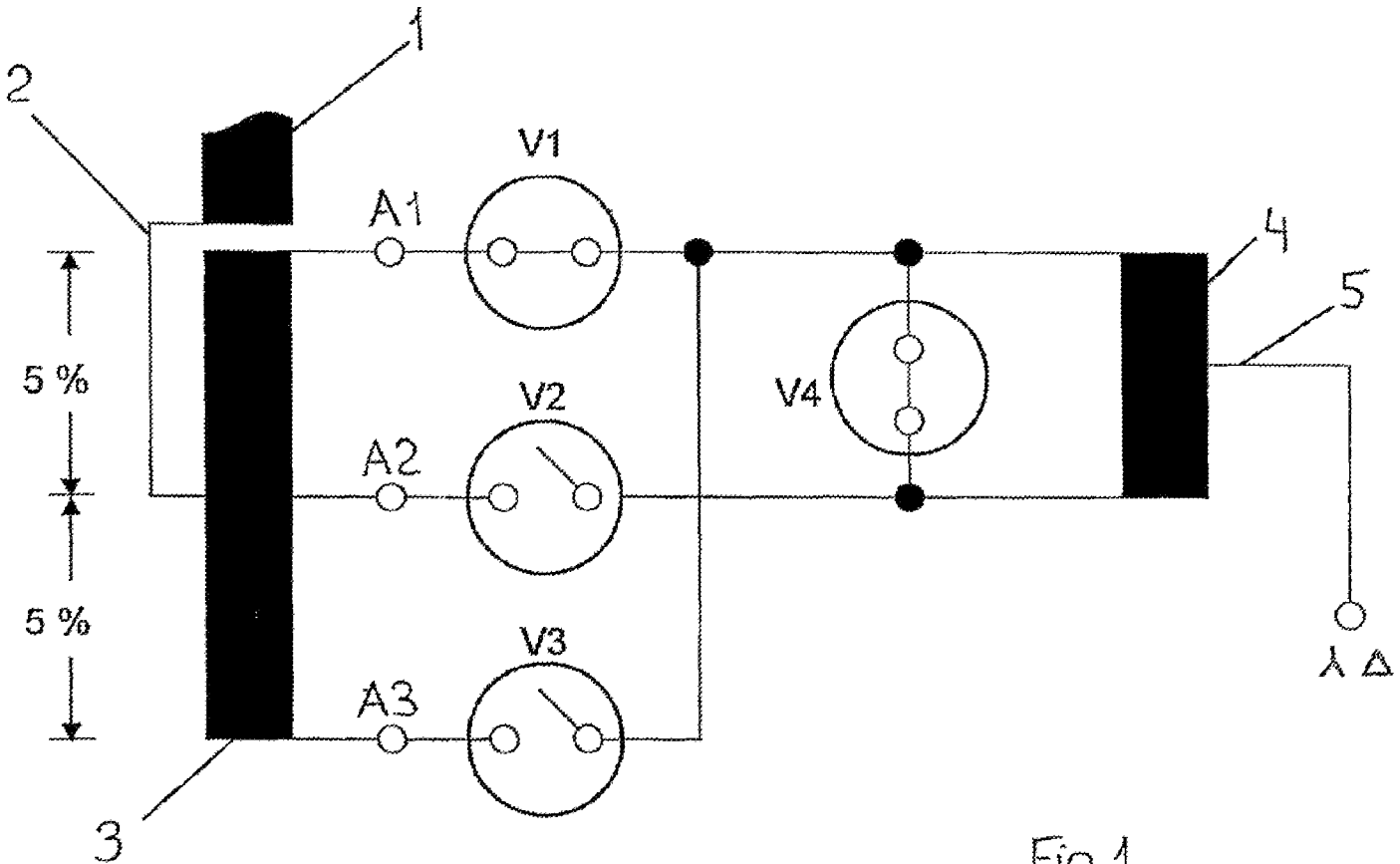
FIG. 1 shows a schematic diagram of a first apparatus according to the invention.

In FIG. 1 a first apparatus according to the invention is schematically represented. A primary winding 1 of a control transformer is shown, whose winding end 2 is wired to the center of a separate control winding 3 of the control transformer. The control winding 3 here has three separate taps A1 . . . A3. The taps A1 and A3 are situated at opposite ends of the control winding 3, the tap A2 is exactly in the middle where the connection with the end of the winding 2 of the primary winding 1 is formed. The control winding 3 is dimensioned such that the effective winding lengths between the taps A1 and A2 and between the taps A2 and A3 correspond to 5% of the winding length of the primary winding 1. Of course, other winding lengths are possible as well.

Each of the taps A1 . . . A3 is connected to the input of a circuit element, here a vacuum switch V1 . . . V3. The output of the first vacuum switch V1 that is connected to the tap A1 on the first winding end of the control winding 3, and the output of the second vacuum switch V2 that is connected to the tap A2 in the center of the control winding 3 are directed to both ends of a reactor winding 4; a further circuit element is connected in parallel thereto between the two outputs, here a further vacuum switch V4. The output of the third vacuum switch V3 that is connected to the tap A3 on the other end of the control winding 3 is electrically connected to the output of the first vacuum switch V1. The center of the reactor winding 4 is wired to the output line. For this purpose, a tap 5 is provided on the reactor winding 4.

By operation of the vacuum switches V1 . . . V4, the voltage in this example can be regulated in the range +/−5% in steps of 2.5%.

FIG. 2 shows a table for the example shown in FIG. 1 that illustrates the five different possible voltage levels as a function of the position of the respective vacuum switch V1 . . . V4. Therein, c refers to the closed position ("closed"), whereas o represents the open position of the switch.

It can be seen that these four vacuum switches provide in total five voltage levels. This is due to the fact that on the taps A1 and A3, a voltage is available that differs by +/−5% from the voltage at the tap A2 and that by switching of the reactor winding 4, half of this amount, that is 2.5%, can be superposed.

Control of the vacuum switches V1 . . . V4 is easily possible for example by means of cams, since regardless of the switching direction, toward "higher voltage" or "lower voltage", a very simple operation sequence results from easy up or down switching.

Figure 3:
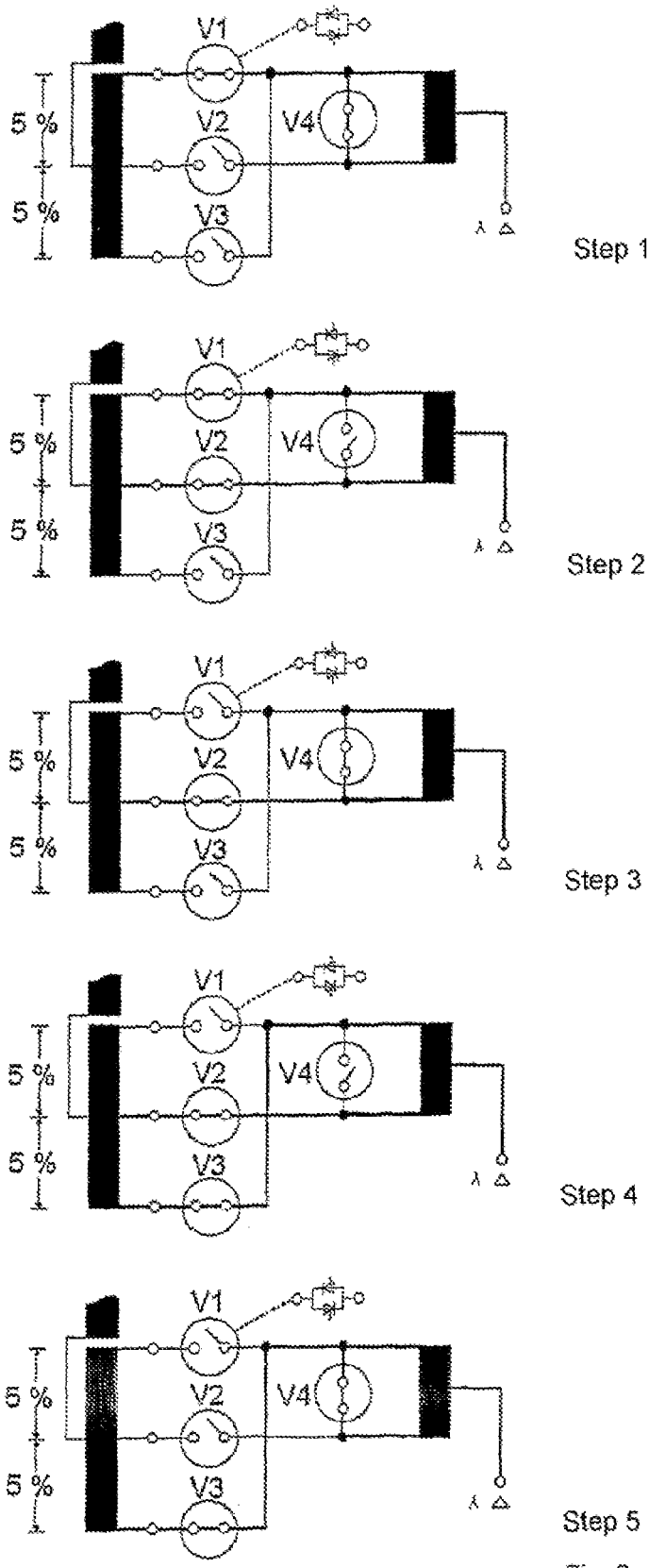
FIG. 3 shows the respective positions of the individual circuit elements at these voltage levels.

FIG. 3 shows the different positions of the vacuum switches V1 . . . V4 of the circuit shown in the FIG. 1 and discussed above on the individual voltage levels, as is shown in the table in FIG. 2.

Figure 4:
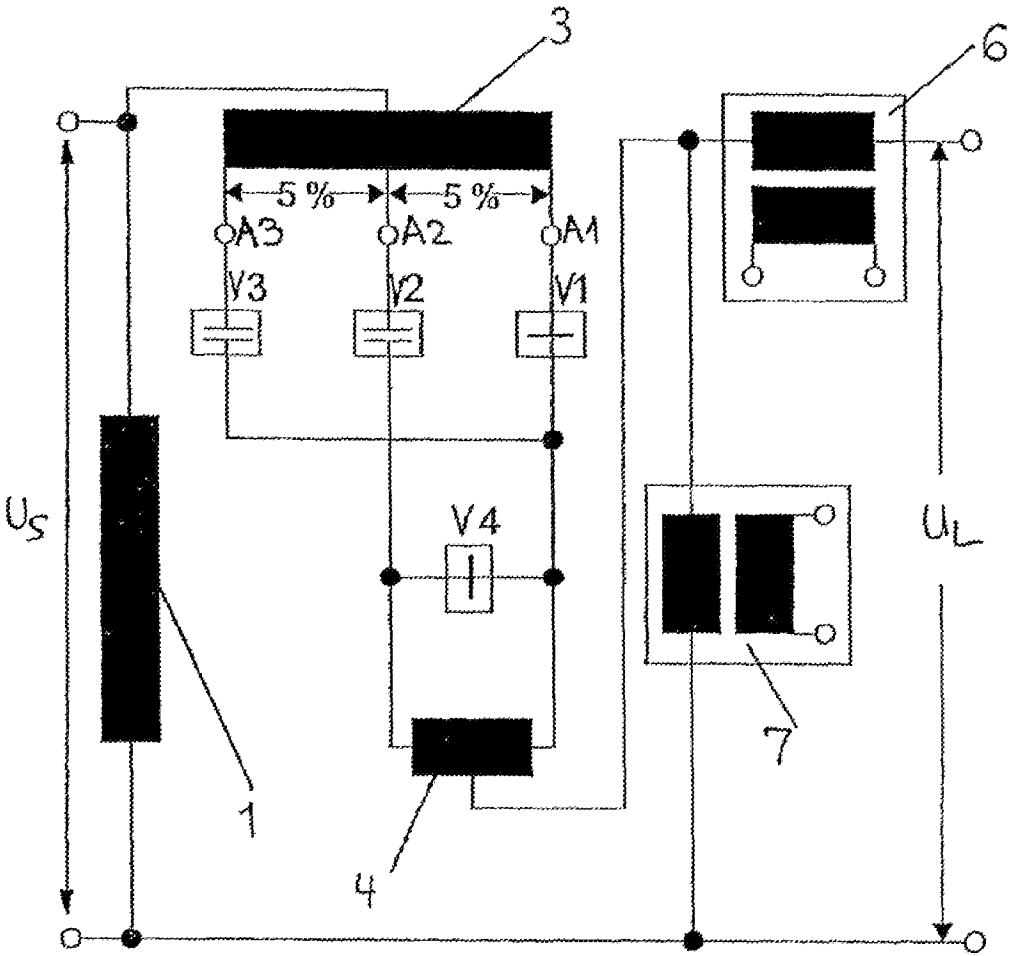
FIG. 4 shows a further apparatus according to the invention for regulating voltage on the load side of a voltage regulator.

FIG. 4 shows an arrangement according to the invention as a component of a voltage regulator for regulation on the load side. It shows how the input voltage Us is applied to the primary winding 1, the end of which leads to the central tap A2 of the control winding 3. The taps A1 and A3 are connected to respective ends of the control winding 3, again at a winding spacing each of 5% along the primary winding. The positions and functions of the vacuum switches V1 . . . V4 have already been discussed as well as the illustrated reactor winding 4. In addition, a current transformer 6 and a voltage transformer 7 are shown on the load side. Thus, the actual values of current and voltage on the load can be determined in the known manner. By means of a herein unillustrated known controller, a comparison of set value and actual value are compared and as a result, a decision concerning any necessary adjustment that can be a "higher" or "lower" voltage is made. Subsequently, a modification of the switching states of the vacuum switches V1 . . . V4 is made, as shown in FIG. 2. If control of the vacuum switches V1 . . . V4 is effected by means of a cam, rotation of the cams about 72° can be effected for a direction-dependent actuation.

Figure 5:
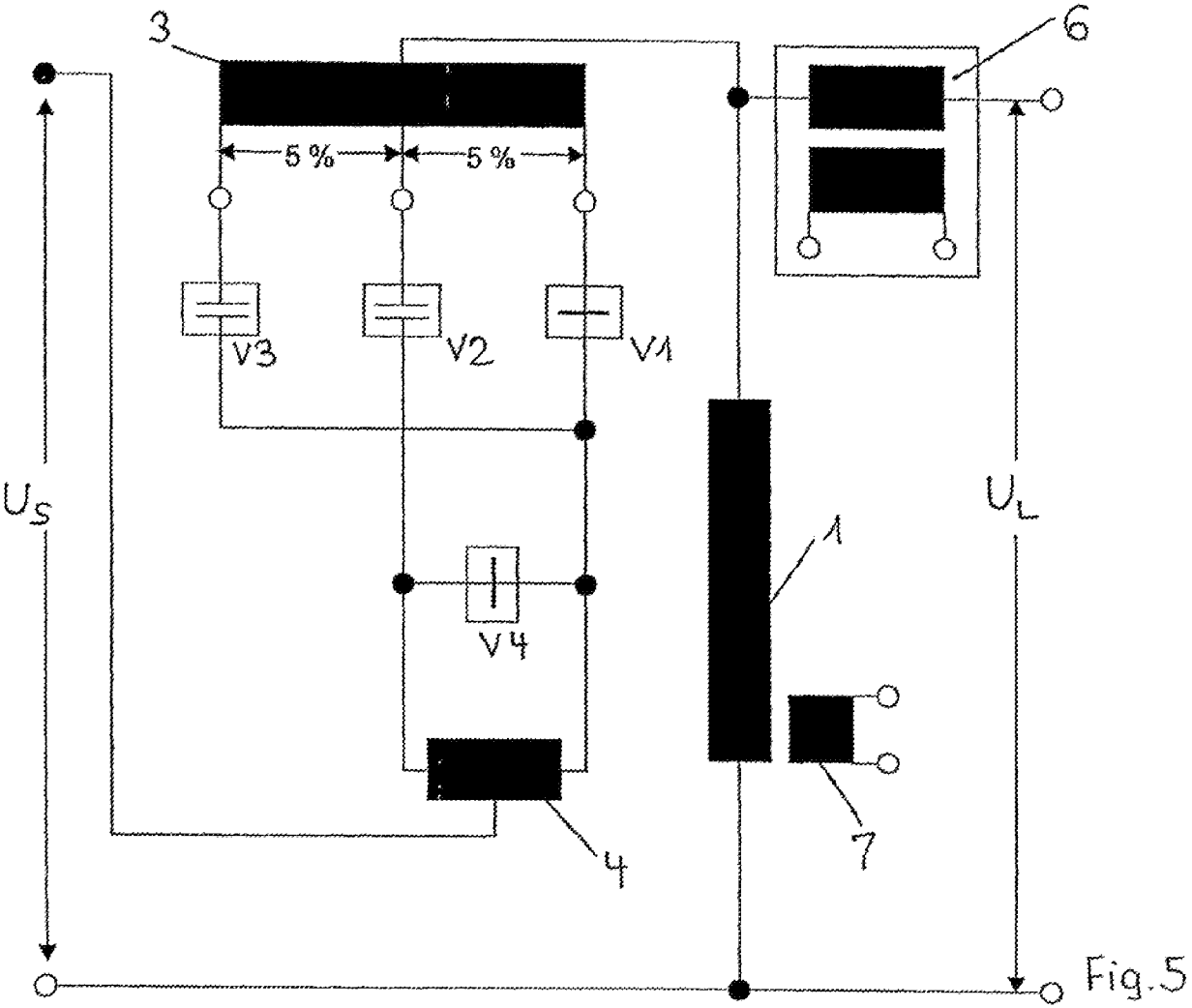
FIG. 5 shows a further apparatus according to the invention for regulating voltage on the primary side of a voltage regulator.

FIG. 5 shows an arrangement according to the invention for regulation on the input (source) side of a voltage regulator. The functional principle is the same as above.

Figure 6:
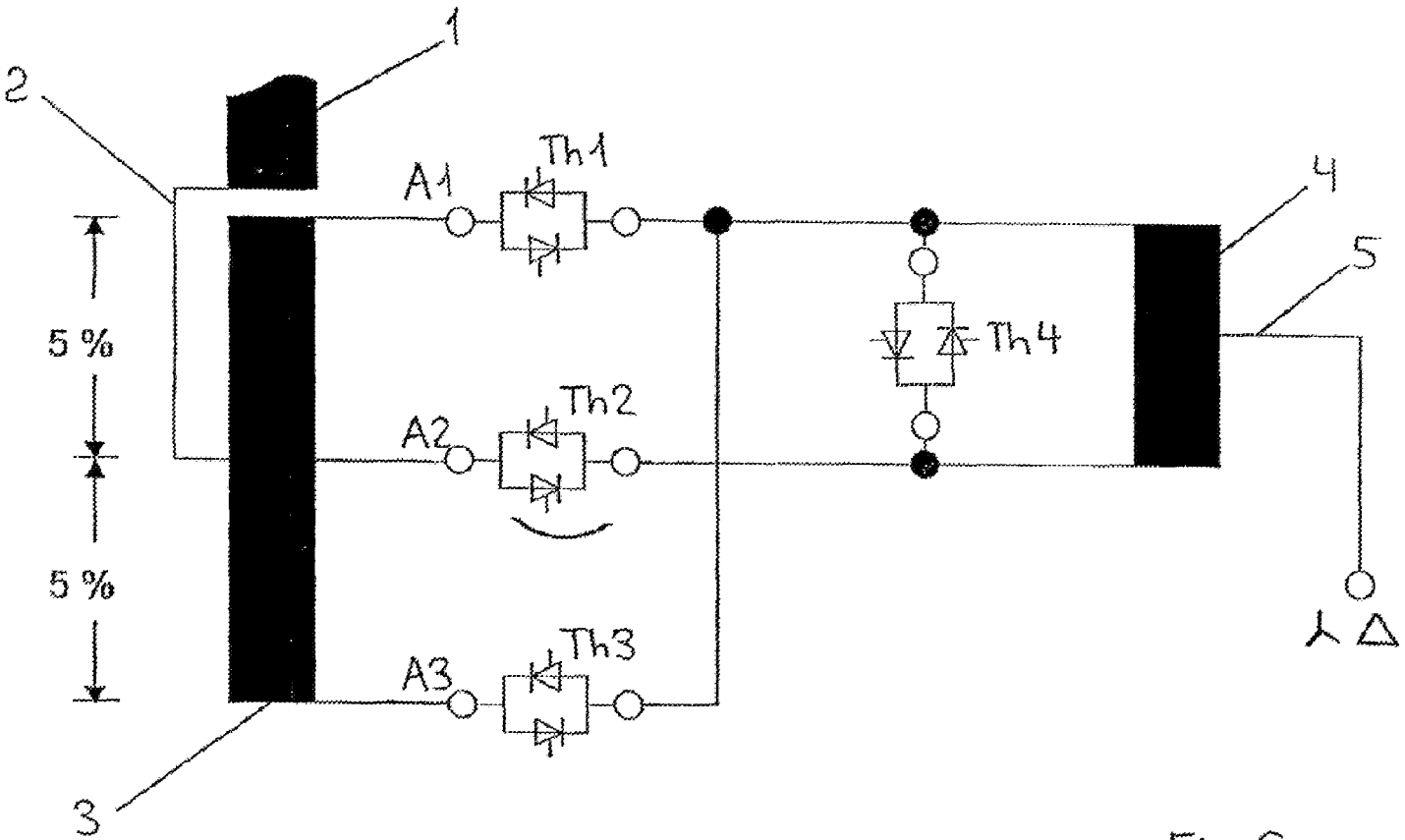
FIG. 6 shows a further apparatus according to the invention having alternatively designed circuit elements.

FIG. 6 shows a further arrangement according to the invention, here using antiparallel thyristor pairs Th1 . . . Th4 as circuit elements.

The described circuit elements can within the scope of the invention as described above be vacuum switches as well as mechanical switches or thyristors. The herein discussed design using thyristors has the advantage that the arrangement according to the invention in total results in a fully static switch, without any moving parts. For driving the thyristor Th1 . . . Th4, the table shown in FIG. 2 for example can be easily embodied as electrical control routine.

Figure 7:
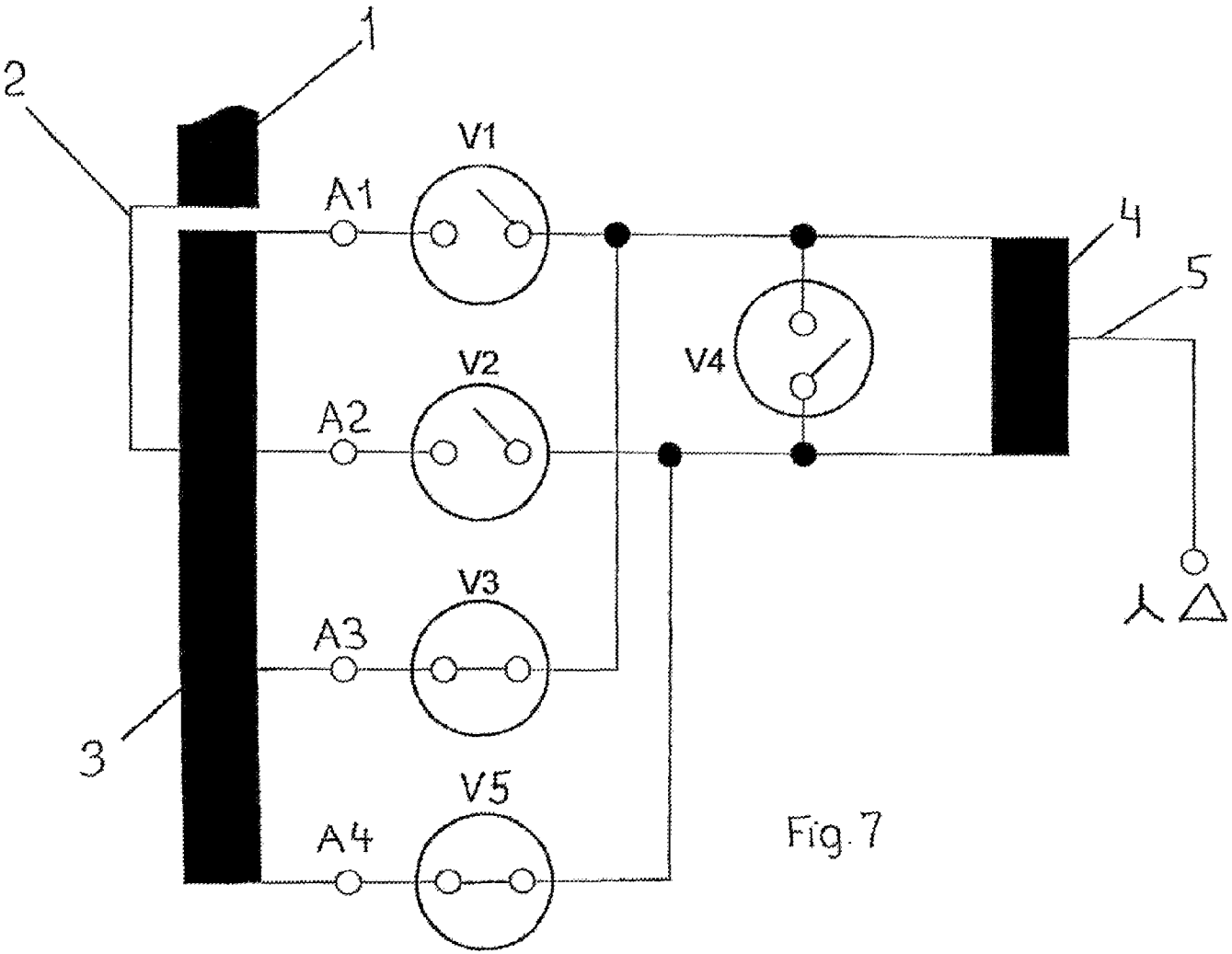
FIG. 7 shows a further apparatus according to the invention with a further developed connection scheme.

Within the scope of the invention, it is also possible to extend the circuit arrangement represented in FIG. 1 in a cascade-like manner by providing more than three taps on the control winding 3 and by switching each of these additional taps with a respective switch. An example thereof with only one additional tap A4 is shown in FIG. 7. The control winding 3 in such embodiment is dimensioned such that the winding length between all taps A1 . . . A4 respectively is the same, for example 5% of the winging length of the primary winding 1. Thus, the skilled in the art can easily calculate the voltage levels that can be additionally achieved according to the invention. This cascade-like principle may be extended as desired.

The invention claimed is:

1. An apparatus for regulating electrical voltage in multiphase power mains, the apparatus comprising:

a control transformer having for each phase of the power mains a primary winding having a pair of ends, and a control winding having first and third end taps and a second tap connected centrally between the first and third taps and connected to one of the ends of the primary winding, the control winding being dimensioned such that winding lengths between the first and second taps and between the second and third taps are each equal to X % of a winding length of the primary winding, X being a whole number;

first, second, and third circuit elements having respective inputs connected respectively to the first, second, and third taps, the circuit elements also having respective outputs;

a reactor winding having ends connected to the outputs of the first and second circuit elements, the output of the third circuit element being electrically connected to the output of the first circuit element;

a further circuit element connected across the reactor winding; and an output connected to a center of the reactor winding.

2. The apparatus according to claim 1, wherein X is 5.

3. The apparatus according to claim 1, wherein vacuum switches are used as the circuit elements.

4. The apparatus according to claim 1, wherein semiconductor switches are used as circuit elements.

5. The apparatus according to one of claim 1 wherein the control winding has at least one additional tap, the apparatus further comprising a further circuit element having an input connected to the additional tap and an output connected to the output of the second circuit element for increasing the number of possible voltage levels.

* * * * *